US008096088B2

(12) United States Patent
Poirier et al.

(10) Patent No.: US 8,096,088 B2
(45) Date of Patent: Jan. 17, 2012

(54) GLAZING ASSEMBLY FOR ROUGH OPENINGS

(75) Inventors: Peter P. Poirier, Ashland, OH (US); Michael Sebold, Cleveland, OH (US)

(73) Assignee: Tremco Incorporated, Beachwood, OH (US)

( * ) Notice: Subject to any disclaimer, the term of this patent is extended or adjusted under 35 U.S.C. 154(b) by 767 days.

(21) Appl. No.: 11/583,505

(22) Filed: Oct. 19, 2006

(65) Prior Publication Data

US 2008/0092463 A1 Apr. 24, 2008

(51) Int. Cl.
*E06B 3/00* (2006.01)

(52) U.S. Cl. ..... 52/204.5; 52/302.6; 52/58; 52/60

(58) Field of Classification Search ..... 52/58, 60, 52/63, 204.5, 208, 222, 302.6
See application file for complete search history.

(56) References Cited

U.S. PATENT DOCUMENTS

| | | | | |
|---|---|---|---|---|
| 3,024,503 | A * | 3/1962 | Zoellner | 52/775 |
| 3,209,669 | A | 10/1965 | Bayne | |
| 3,421,276 | A | 1/1969 | La Barge | |
| 3,623,288 | A | 11/1971 | Horowitz | |
| 3,696,575 | A | 10/1972 | Armstrong | |
| 3,760,544 | A | 9/1973 | Hawes et al. | |
| 3,838,544 | A | 10/1974 | Hindall | |
| 4,184,297 | A | 1/1980 | Casamayor | |
| 4,385,850 | A | 5/1983 | Bobath | |
| 4,539,243 | A | 9/1985 | Miller | |
| 4,689,930 | A | 9/1987 | Menchetti | |
| 4,700,512 | A | 10/1987 | Laska | |
| 4,821,472 | A | 4/1989 | Tix | |
| 4,873,803 | A * | 10/1989 | Rundo | 52/202 |
| 4,999,957 | A | 3/1991 | Kessler | |
| 5,018,333 | A * | 5/1991 | Bruhm | 52/741.4 |
| 5,077,943 | A | 1/1992 | McGady | |
| 5,119,609 | A * | 6/1992 | Tait et al. | 52/213 |
| 5,154,025 | A | 10/1992 | Brown | |
| 5,396,746 | A * | 3/1995 | Whitmer | 52/208 |
| 5,590,496 | A | 1/1997 | Martin et al. | |

(Continued)

FOREIGN PATENT DOCUMENTS

| | | |
|---|---|---|
| CH | 672162 | 10/1989 |

(Continued)

OTHER PUBLICATIONS

"elastomeric." Collins English Dictionary—Complete & Unabridged 10th Edition. HarperCollins Publishers. Mar. 17, 2011. <Dictionary.com http://dictionary.reference.com/browse/elastomeric>.*

(Continued)

*Primary Examiner* — Brian Glessner
*Assistant Examiner* — Patrick Maestri
(74) *Attorney, Agent, or Firm* — Calfee, Halter & Griswold, LLP

(57) ABSTRACT

A barrier assembly for sealing the gap between the frame of a window and the rough opening of a building in which the window is received comprises an adaptor attached to the window frame and a sealing membrane providing an air and moisture barrier between the window frame and the framing members defining the building's rough opening. The flexible sealing membrane is formed from multiple membrane sections, at least one of which is formed from a flexible sheet and a projection integral with the flexible sheet, the projection being received in a channel defined by the adaptor to provide an air and moisture-proof barrier seal between the window frame and the associated building framing members.

45 Claims, 10 Drawing Sheets

U.S. PATENT DOCUMENTS

| | | | | |
|---|---|---|---|---|
| 5,706,610 | A * | 1/1998 | Mayle | 52/60 |
| 5,937,597 | A | 8/1999 | Sono et al. | |
| 6,052,956 | A | 4/2000 | Hoy et al. | |
| 6,085,481 | A | 7/2000 | Lee | |
| 6,148,584 | A * | 11/2000 | Wilson | 52/717.01 |
| 6,244,013 | B1 | 6/2001 | Lee | |
| 6,467,226 | B2 | 10/2002 | Dodson et al. | |
| 6,482,500 | B1 | 11/2002 | Diginosa | |
| 7,290,379 | B2 | 11/2007 | Allen | |
| 7,654,046 | B2 | 2/2010 | Ellingson | |
| 2001/0034984 | A1 | 11/2001 | Murphy et al. | |
| 2005/0072076 | A1 | 4/2005 | Fulton et al. | |
| 2005/0144856 | A1 | 7/2005 | Conlin | |
| 2006/0260213 | A1 | 11/2006 | Williams | |
| 2007/0011960 | A1 | 1/2007 | Richardson | |
| 2008/0092463 | A1 | 4/2008 | Poirier et al. | |

FOREIGN PATENT DOCUMENTS

| | | | |
|---|---|---|---|
| DE | 20209785 | | 10/2002 |
| DE | 20209785 | | 11/2002 |
| DE | 102004019859 | | 11/2005 |
| EP | 14870 | A1 | 9/1980 |
| EP | 796972 | | 9/1997 |
| EP | 0796972 | | 9/1997 |
| GB | 2246386 | | 1/1992 |

OTHER PUBLICATIONS

PCT/US2007/079358, Int'l Search Report from corresponding WO application, Jan. 23, 2008, European Patent Office.

Meeting memorandum describing certain meeting attend by Peter Poirier (inventor); dated Jul. 1, 2005; 5 pages.

Proglaze ETA, internal slide show presentation describing certain industry practices, 95 pages, known prior art.

International Search Report from PCT/US07/079358, mailed Jan. 23, 2008.

Installation Instructions brochure, Proglaze ETA, Tremco Commercial Sealants & Waterproofing, Jan. 2008, 8 pgs.

Proglaze ETA Engineered Transition Assembly, Clear Proof of a Perfect Seal brochure, 2 pgs., Jan. 2008, Tremco Commercial Sealants & Waterproofing.

* cited by examiner

GLAZING ASSEMBLY FOR ROUGH OPENINGS

FIELD OF THE INVENTION

This invention relates to an assembly for providing an air and moisture-proof seal between the frame of a window and the rough opening of the building in which the window is received.

BACKGROUND

The gap between the frame of the widow and the rough opening of the building in which the window is received can be quite large, e.g., as large as 3 inches (~7.5 cm) or more. Although this gap is normally covered by molding, flashing or other material, additional steps are usually taken to seal this gap against penetration by air and moisture. In some instances, the window installer fills this gap with caulk or polymer foam supplied from a pressured container. In other instances, the installer covers this gap with a sheet of butyl rubber or like elastomer, typically using a pressure sensitive adhesive to adhere the sheet to the window frame and the surrounding building framing members.

Modern industrial windows provide excellent thermal and moisture resistance. Unfortunately, the same cannot be said for the means currently being used to seal the gap between such windows and the rough opening in which they are received. Caulk becomes largely ineffective when the gap is larger than about 1 inch (~2.54 cm). Insulating foam cannot accommodate joint movement and can degrade over time. Elastomeric sheets, meanwhile, can be difficult to lay down evenly and uniformly, especially at the window's corners. For example, elastomeric sheets are typically folded over on themselves, substantially puckered or multiply overlapped to get them to fit it into proper position at the window's corner. This often prevents a good seal from being formed due to the excessive or extra material involved.

SUMMARY OF THE INVENTION

In accordance with this invention, a new assembly is provided to obviate these problems, this new assembly employing a flexible sealing membrane for providing the desired air and moisture-proof seal and associated hardware for securing this sealing membrane to the window frame.

Thus, the present invention provides a barrier assembly for sealing the gap between the frame of a window and the rough opening of a building in which the window is received, the rough opening being defined by building framing members, the barrier assembly comprising an adaptor attached to the window frame, the adaptor defining a channel along at least a majority of the perimeter of the window frame, and a flexible sealing membrane providing an air and moisture barrier between the window frame and the building framing members, the flexible sealing membrane being formed from multiple membrane sections, at least one of the membrane sections being formed from a flexible sheet and a projection integral with the flexible sheet, the projection being received in the channel of the adaptor to provide an air and moisture-proof barrier between the window frame and the associated building framing member.

In addition, the present invention also provides a kit for forming an air and moisture-proof seal between the frame of a window and the rough opening in which the window is received, the rough opening being defined by building framing members, the window frame having corners defined by intersecting frame sides, the kit comprising adaptor stock for attaching to a section of the window frame, the adaptor stock defining an elongated channel, and sealing membrane stock for forming a sealing membrane for providing an air and moisture barrier between the window frame and the building framing members, the sealing membrane stock being formed from a flexible sheet defining a projection thereon, the projection being sized to closely fit into the elongated channel of the adaptor stock for providing a secure mechanical connection between the sealing membrane stock and the adaptor stock.

Moreover, the present invention still further provides a pre-fabricated corner membrane for combining with elongated adaptors thereby forming an air and moisture-proof seal between the frame of a window and the associated building framing members of a building defining the rough opening in which the window is received, the window frame having corners defined by intersecting frame sides, the corner membrane comprising a flexible sheet defining first and second inside lateral edges for association with the window frame, the flexible sheet having a major face defining a projection thereon being proximate to and extending along the first inside lateral edge, the major face also defining a second projection thereon being proximate to and extending along the second inside lateral edge, the projection being sized to closely fit into the channel of the associated adaptors for providing a secure mechanical connection between the membrane section and the adaptors, the corner membrane being formed from a molded elastomeric material whereby the projection and flexible sheet of the membrane are integral with respect to one another.

Finally, the present invention also provides a process for forming an air and moisture-proof seal between the frame of a window and the rough opening in which the window is received, the rough opening being defined by building framing members, the window frame having corners defined by intersecting frame sides, the process comprising attaching multiple adaptor sections to the window side frames thereby forming an adaptor defining a channel along at least a majority of the perimeter of the window, and attaching multiple membrane sections to the adaptor, to one another, and to the associated building framing members of the building thereby forming a sealing membrane providing an air and moisture barrier between the window frame and the building framing members, at least one of the membrane sections being formed from a flexible sheet having a major face defining a projection thereon, the projection being sized to closely fit into the channel of the associated adaptor section for providing a secure mechanical connection between the membrane section and the adaptor section.

BRIEF DESCRIPTION OF THE DRAWINGS

The present invention may be more readily understood by reference to the following drawings wherein.

DETAILED DESCRIPTION

The inventive barrier assembly is intended primarily for use in connection with windows used in industrial buildings such as office buildings, sky-scrapers, factories, schools, hospitals and the like. Windows used in these buildings ("industrial windows") are considerably larger than a typical house window. In addition, they are commonly custom-manufactured on-site from individual panes of glass and suitable window frame sections. These window frame sections are typically made from aluminum or aluminum alloy, have a fairly complex cross-sectional profile, and are fabricated by the glazer on-site by cutting a section of appropriate length from a stock piece of indeterminate length. The window is then built by attaching these frame segments to the glass pane or panes, with the individual frame sections typically being secured to one another at the window's corners. In some cases, a window frame section can be formed from inner and outer cooperating segments, with the inner segment being attached to the building first before the glass pane or panes and outer segment are attached thereto to form the completed window.

Figure 1:
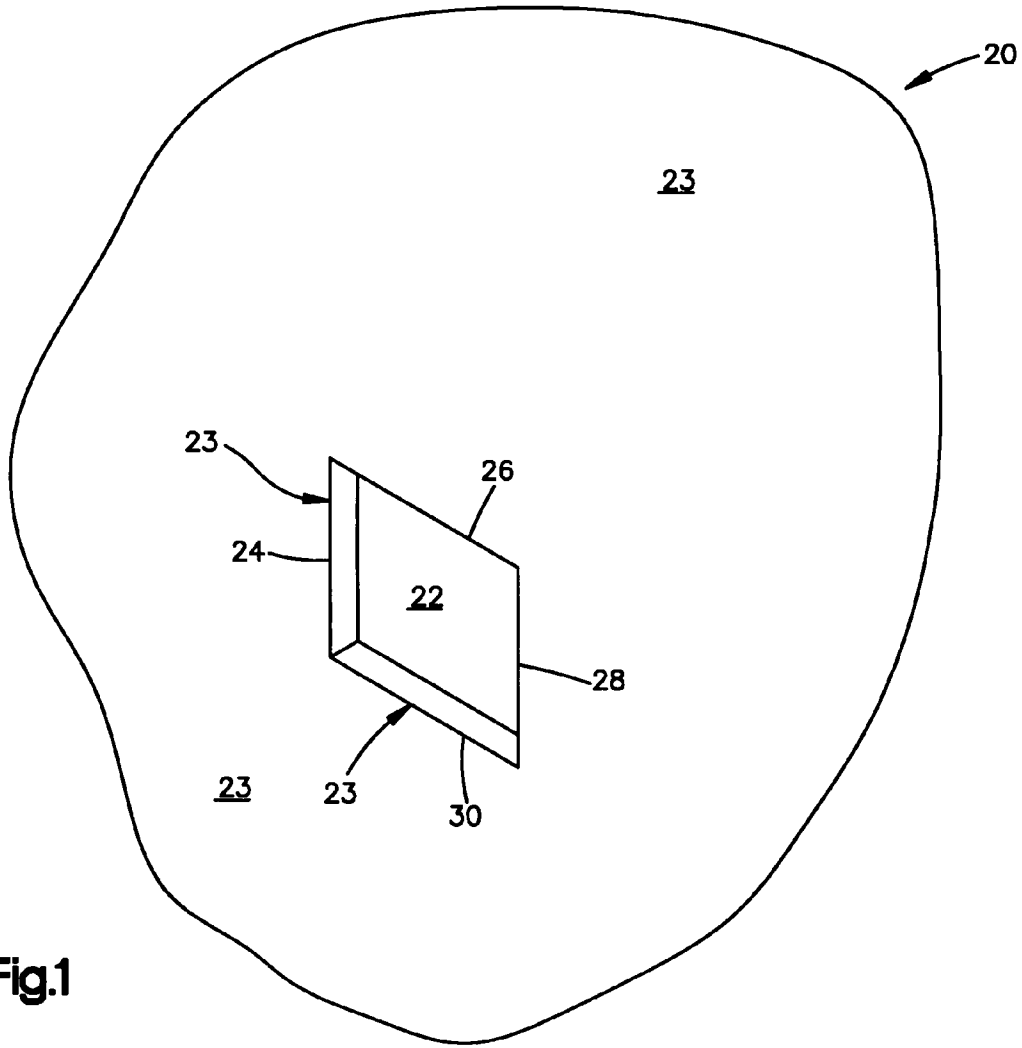
FIG. 1 is a schematic illustration of the wall of an industrial building having a rough opening for receiving an industrial window, the figure illustrating the frame members defining the rough opening.

FIG. 1 illustrates a portion of the exterior structural wall 20 of a conventional industrial building such as an office building, sky-scraper, factory, school, hospital or the like. This exterior structural wall defines rough opening 22 therein for receipt of a window. Normally, a building siding material (not shown) such as brick, stone, wood or plastic boards or shingles, aluminum sheet or siding, or the like is applied to the outside of exterior structural wall 20 to form the outermost surface layer or "fascia" of the building.

As shown in FIG. 1, the portions of exterior structural wall 20 defining rough opening 22 can be viewed as comprising building framing members 24, 26, 28 and 30 associated with the window to be received in rough opening 22. If exterior structural wall 20 was formed from a frame made from boards, studs, girder or cinderblocks, for example, the boards, studs, girders, cinderblocks or other structures defining rough opening 22 could be considered as building framing members 24, 26, 28 and 30.

To provide an air and moisture-proof seal, "air barrier" 23 in the form of a plastic sheet or sprayed-on layer of plastic is provided between exterior structural wall 20 and the building's outer surface or fascia. In the particular embodiment shown, air barrier 23 extends around the outermost front edges of building framing members 24, 26, 28 and 30 and into rough opening 22 for providing a complete seal of exterior structural wall 20.

When an industrial window is placed in rough opening 22, a gap is normally formed between the outside edges of the window frame and the facing surfaces of associated building framing members 24, 26 and 28 and possibly 30, this space usually being larger than ½ inch (~1.25 cm) and often as large as 2 or 3 inches (~5-8 cm) or even larger. In accordance with this invention, the inventive barrier assembly is provided to effect a permanent air and moisture-proof seal of this gap.

Figure 2:
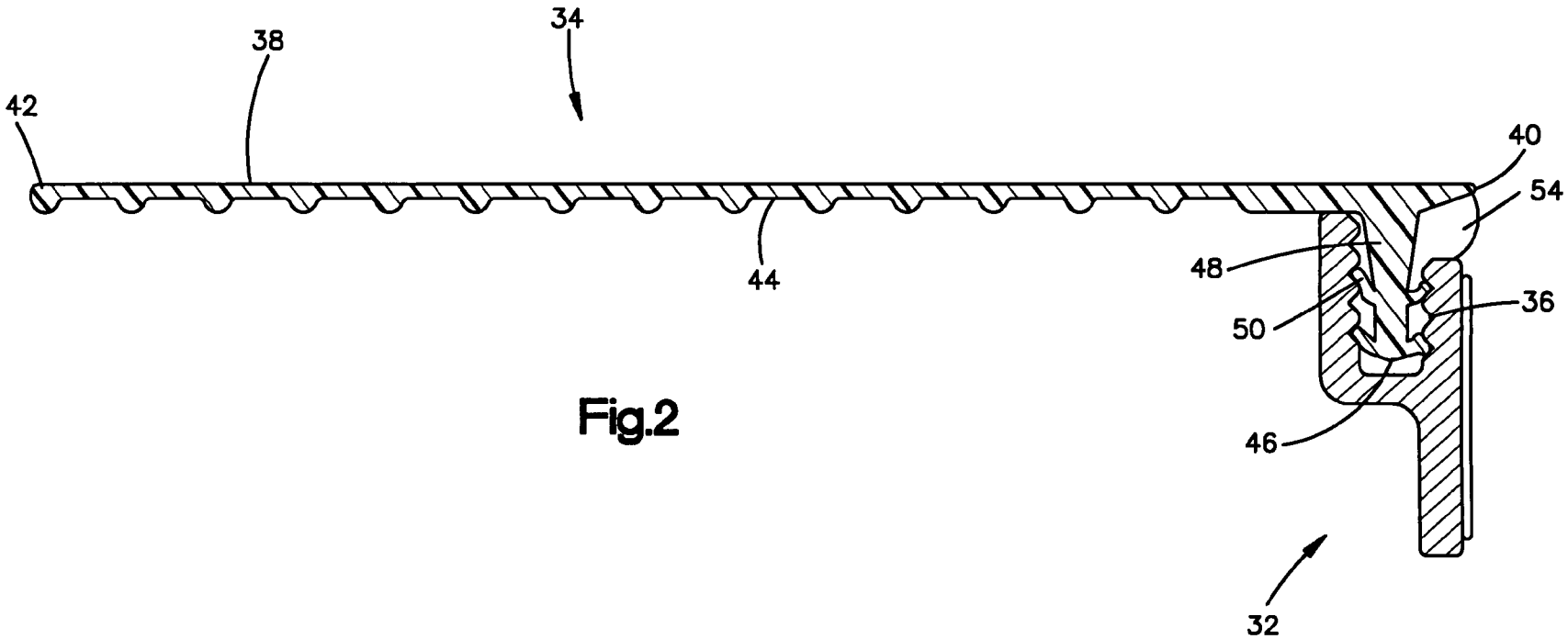
FIG. 2 is a transverse cross-sectional view illustrating the adaptor and the sealing membrane of the inventive barrier assembly when in an assembled condition.

As shown in FIG. 2, the inventive barrier assembly comprises an elongated adaptor 32, typically made by extrusion, and a flexible sealing membrane 34. Flexible sealing membrane 34 takes the form of a flexible sheet 38 and a projection or "dart" 46 associated therewith. Flexible sheet 38 defines in its longitudinal direction free inside lateral edge 40 associated with the frame of the window, free outside lateral edge 42 associated with the sides of rough opening 22, and major face 44 between inside lateral edge 40 and outside lateral edge 42. In this context, "free" means that inside lateral edge 40 and outside lateral edge 42 are not connected to anything else. In the particular embodiment shown, dart 46 extends from major face 44 of flexible sheet 38 intermediate free inside lateral edge 40 and outside lateral edge 42 proximate its inside lateral edge 40, although other structures are possible. Meanwhile, adaptor 32 defines a channel or "race" 36 for receiving dart 46 of flexible sealing membrane 34.

As shown in FIG. 2, dart 46 of sealing membrane 36 in the particular embodiment shown is formed by a central shaft 48 carrying multiple protrusions or "wings" 50 which are received in complementary grooves 52 defined in the inside surfaces of race 36 of channel member 32. This complementary wing and groove arrangement not only enhances the mechanical strength of the junction between flexible sealing membrane 34 and channel member 32 but also creates a mechanical seal between these two components. If desired, a quantity 54 of moisture-proof sealant can be placed in race 36 before dart 46 is inserted therein for achieving an even more secure air and moisture-proof seal between these two components. Preferably, enough sealant is used so that this bead of sealant also seals adaptor 32 to the surrounding window frame.

Sealing membrane 34 may be made by molding or extruding an elastomeric material such as butyl rubber, neoprene rubber, EPDM, silicone rubber or the like. In this instance, sealing membrane 34 is composed of a single unitary member with dart 46 and flexible sheet 38 both being flexible, elastic and integral with respect to one another. Moreover, when sealing membrane 34 is made by extrusion, dart 46 extends along the entire length of sealing membrane 34, normally proximate its inside lateral edge 40. Sealing membrane 38 may, however, be made from other materials such as various different kinds of plastics or even metals, if desired. In addition, sealing membrane 34 can be made so that dart 46 extends less than the entire length of the sealing membrane, it being preferable that dart 46 extends at least a substantial portion of this length. Dart 46 can also be located in a central portion of flexible sheet 38 and/or can also be discontinuous, if desired.

For convenience, sealing membrane 34 as well as adaptor 32 can be supplied in the form of a kit for custom manufacturing the inventive barrier assembly by the glazier or installer for a particular window on site. This can be done, for example, by providing adaptor 32 and sealing membrane 34 in the form of stock pieces of indeterminate length for subdividing into multiple adaptor sections and sealing membrane sections of appropriate length on site.

Figure 11:
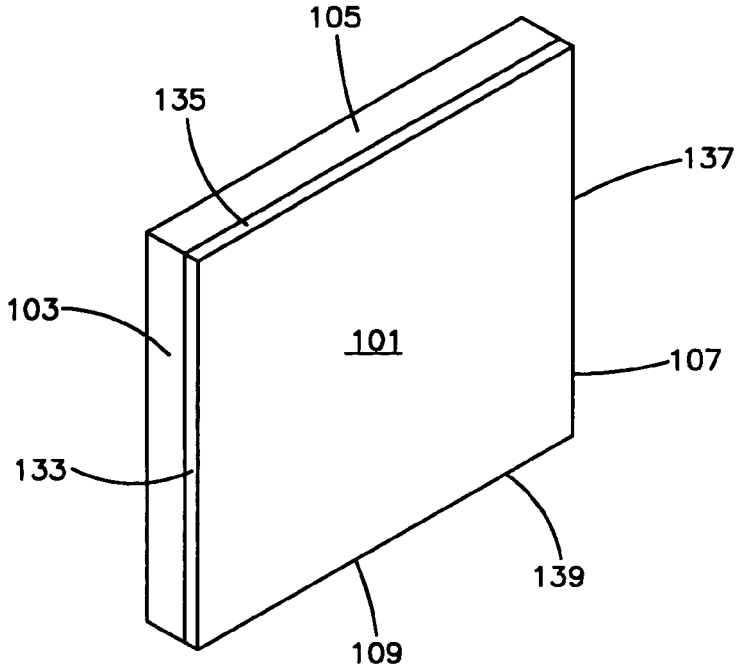
FIG. 11 is a perspective view of an industrial window illustrating the inventive barrier assembly being positioned on all four sides of the window.
Figure 12:
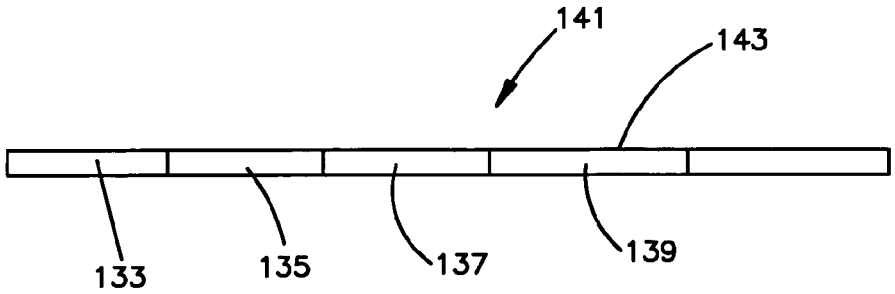
FIG. 12 is a perspective view illustrating how a piece of adaptor stock of indeterminate length can be subdivided into adaptor sections for custom manufacturing the inventive barrier assembly on site.

This is illustrated in FIGS. 11 and 12 which shows adaptor stock 141 in the form adaptor supply piece 143 of indeterminate length being provided for building a barrier assembly of this invention for window 101. In this context, "indeterminate length" means that the supply piece 143 has no particular length other than being longer than the individual adaptor sections which are to be used in making this barrier assembly. As illustrated in FIG. 11, all four of sides 103, 105, 107 and 109 of industrial window 101 are provided with adaptor sections 133, 135, 137 and 139 which, in the aggregate, form adaptor 132 of the inventive barrier assembly. In the particular embodiment shown, each side 103, 105, 107 and 109 of window 101 is provided with only a single adaptor section 133, 135, 137 and 139 extending substantially the entire length of its respective window side. However, some or all of these window sides can be provided with multiple adaptor sections, if desired, and moreover the adaptor section or sections carried by some or all of these side can extend less than substantially the entire length of its respective side, if desired. In any event, construction of the inventive barrier assembly is greatly facilitated with this approach, since only a single adaptor stock piece 143 is needed for supplying multiple adaptor sections of different lengths, as desired. Although not illustrated, sealing membrane sections can be supplied in the same way from sealing membrane stock in the form of a sealing membrane supply piece of indeterminate length.

In another kit approach, the sealing member stock in the kit can be formed from one or more adaptor sections which have already been sized into appropriate, predetermined lengths. Similarly, the sealing member stock in the kit can be formed from one or more sealing membrane sections which have already been sized into appropriate, predetermined lengths.

In both kit approaches described above, the kit can also include one or more corner sealing membranes, as further discussed below in connection with FIG. 7.

Figure 3:
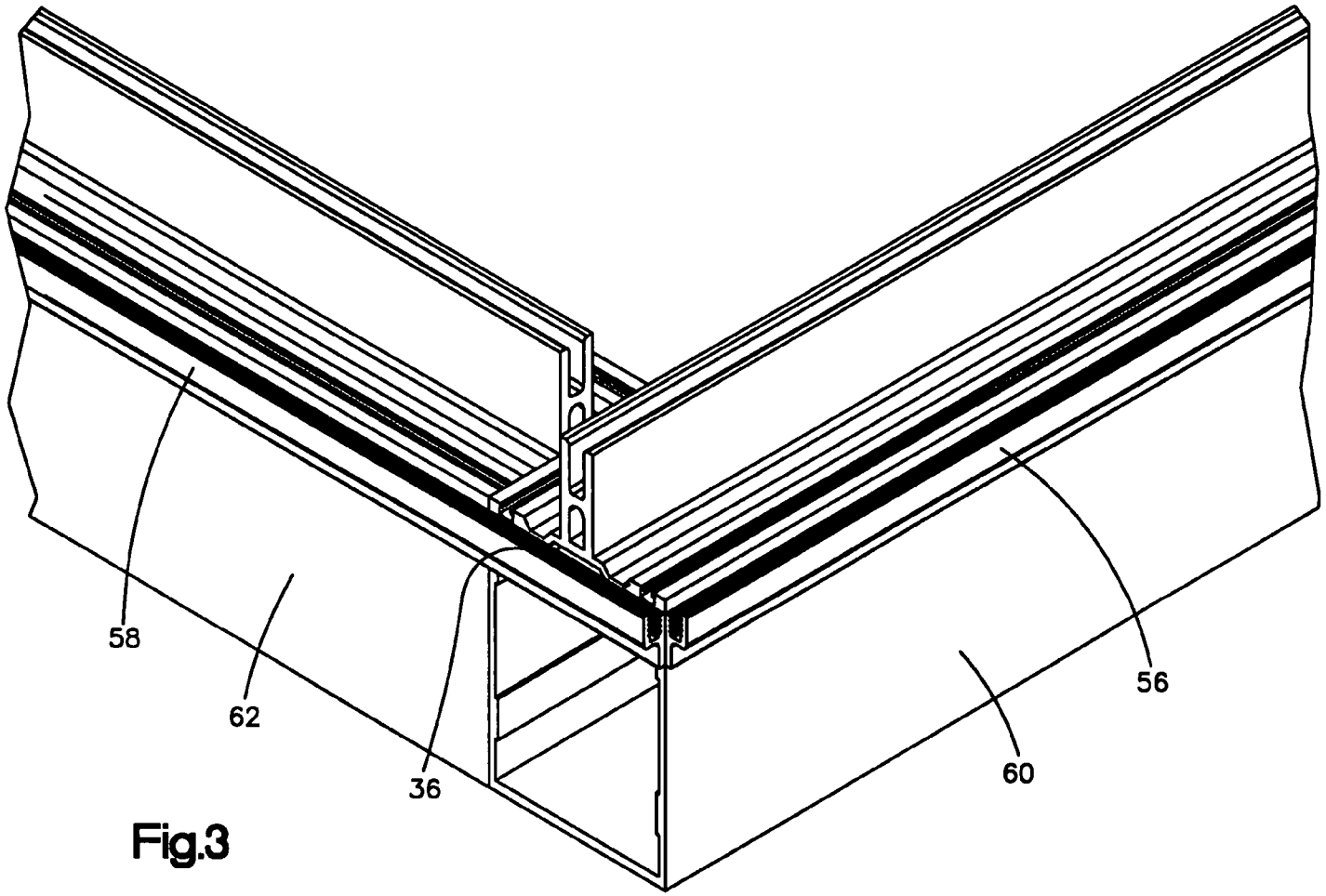
FIG. 3 is a perspective view showing the corner of an industrial window frame having an adaptor section of the inventive barrier assembly mounted on each window frame side section forming the corner.

FIGS. 3, 4, 5 and 6 illustrate how a barrier assembly made in accordance with one embodiment of the invention can be fabricated and installed. As shown in FIG. 3, multiple adaptor sections 56 and 58 are attached to frame sections 60 and 62 of an industrial window in a manner such that they define adaptor 32 forming race 36 extending along at least a majority and preferably essentially all of the perimeter of the window frame. Although these figures show adaptor sections 56 and 58 being attached to the outside surfaces of window frame sections 60 and 62 such that race 36 is defined outside the lateral periphery of the completed window frame, adaptor sections 56 and 58 can be attached to other faces of these window frame sections, if desired. Additionally and/or alternatively, adaptor sections 56 and 58 can be modified in design such that race 36 is spaced within the lateral periphery of the window frame. Even in this instance, however, it is still desirable that race 36 defined by such channel member sections extends along at least a majority preferably essentially the entire perimeter of the window frame.

Figure 4:
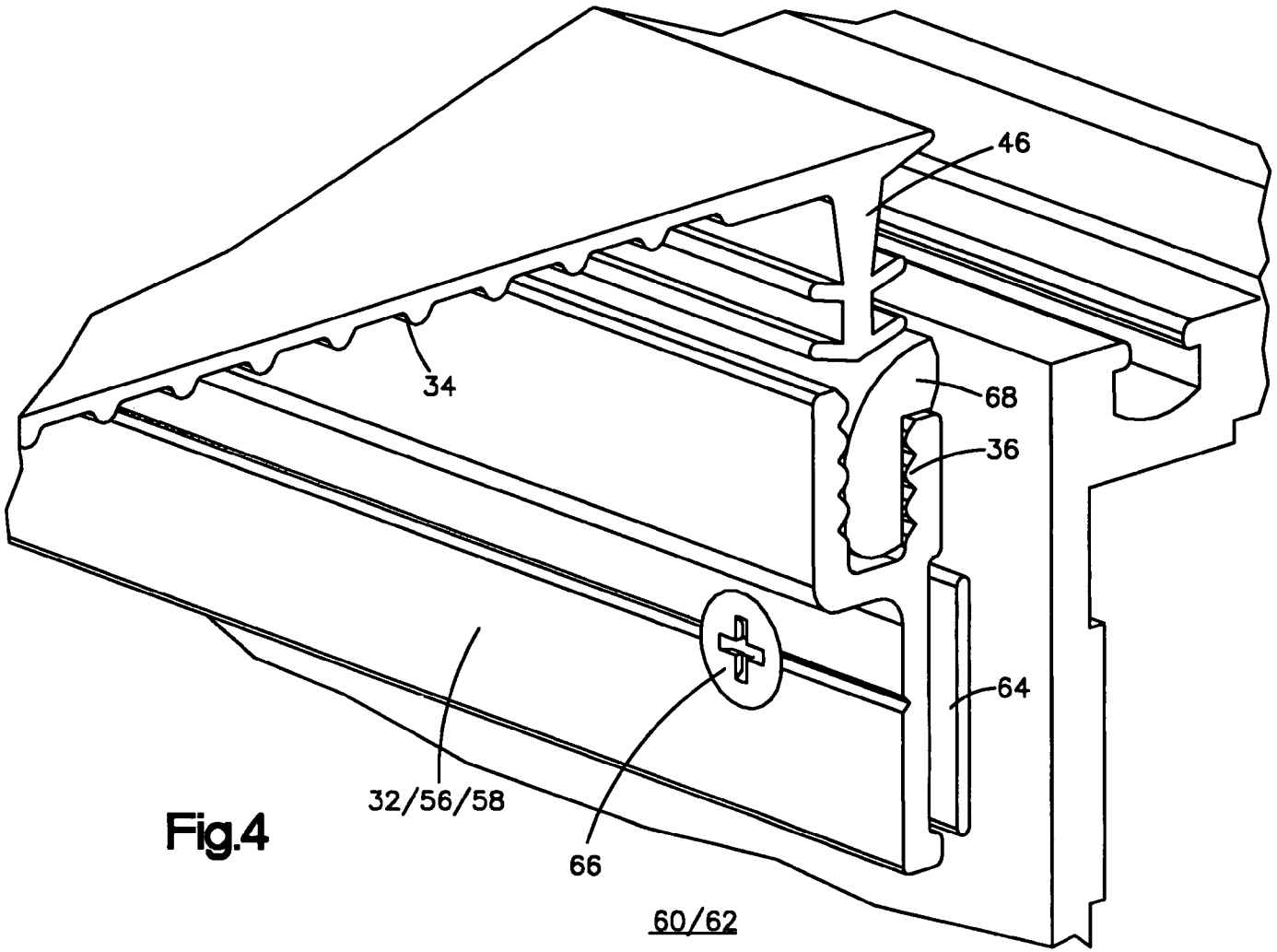
FIG. 4 is an enlarged perspective view illustrating details of how an adaptor section of the inventive barrier assembly may be attached to a window frame side section and, in addition, how a sealing membrane section in accordance with a first embodiment of the inventive barrier assembly may be attached to this adaptor section.

As shown in FIG. 4, adaptor sections 56 and 58 are preferably attached to window frame sections 60/62 by means of a layer 64 of a moisture-proof sealant as well as by screws, a single screw 66 being shown. For this purpose, a bead of sealant can be applied to the channel member sections and/or window frame sections before they are joined or a preformed sealant layer such as a butyl tape can be inserted between these members and sections before they are joined. Other attaching systems can also be used, if desired. Moreover, sealants and mechanical fasteners such as screws and the like can be used individually (i.e., alternatively) rather than in combination, if desired. In addition, a quantity 68 of an optional sealant can also be deposited in race 36 of adaptor sections 56 and 58 for achieving an even better air and moisture-proof seal, if desired.

Figure 5:
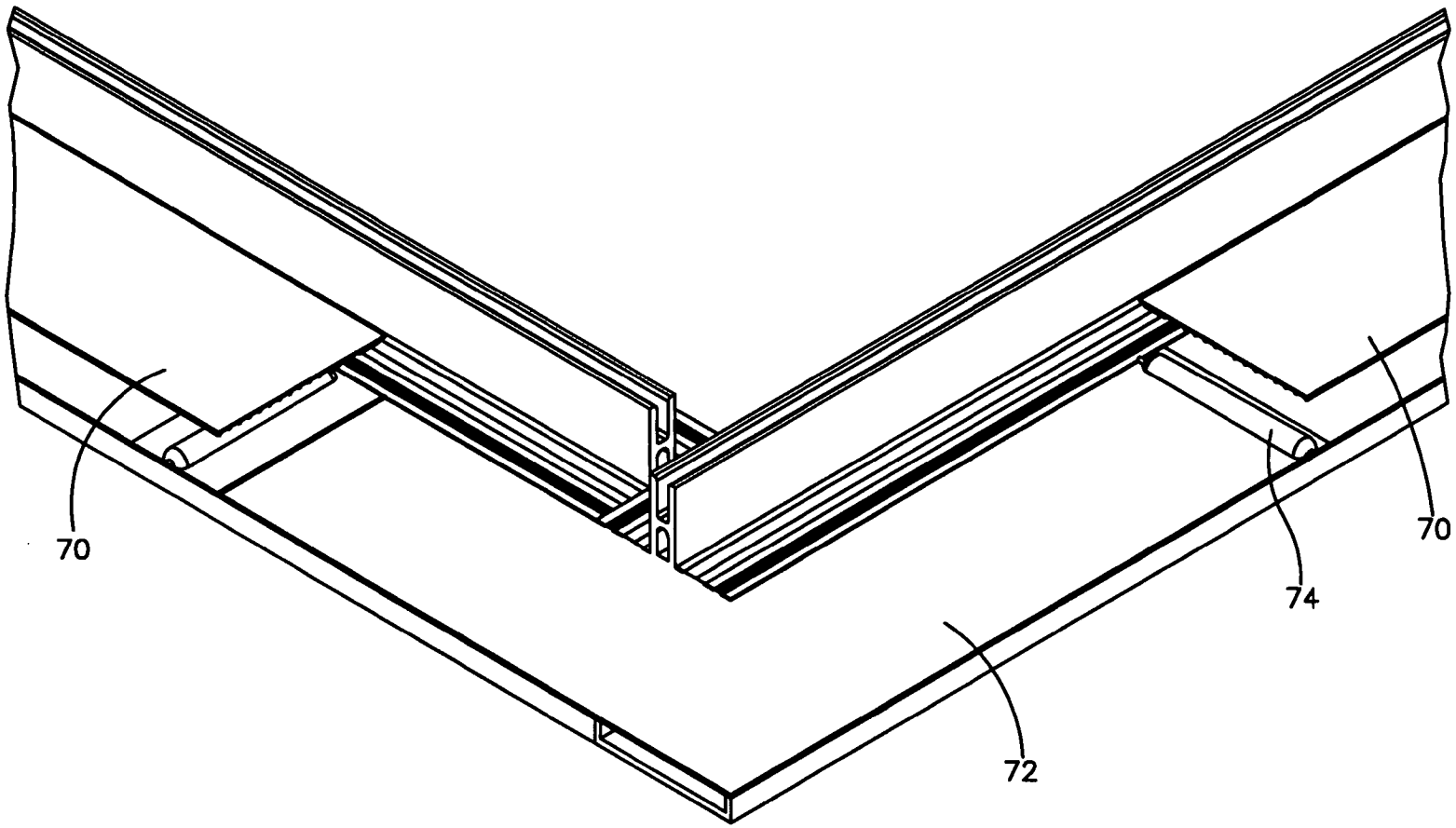
FIGS. 5 and 6 are perspective and plan views, respectively, illustrating how adaptor sections, membrane sections and corner membranes of the inventive barrier assembly, in a first embodiment, are combined to form a moisture-proof sealing membrane of the inventive barrier assembly.
Figure 6:
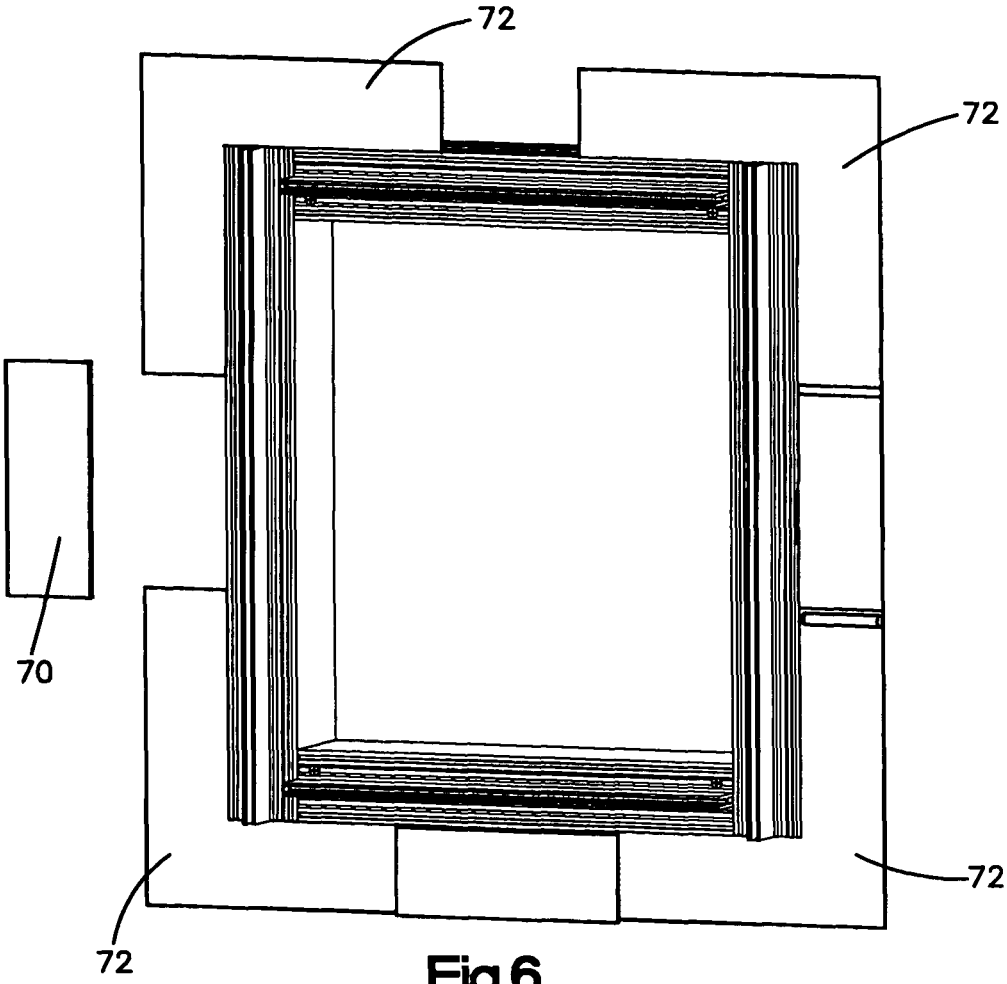

As shown in FIGS. 5 and 6, sealing membrane 34 in the embodiment illustrated in FIGS. 3, 4, 5 and 6 is formed from multiple sealing membrane sections 70 as well as multiple corner membranes 72. For this purpose, corner membranes having the structure illustrated in FIG. 7 can be used. As shown in this figure, corner membrane 72 defines two intersecting portions 74 and 76, each of which defines an inside lateral edge (not shown), these inside lateral edges being arranged at a right angle with respect to one another so as to correspond with the angle of the window frame. Corner membrane 72 in the particular embodiment shown has generally the same cross-sectional profile as illustrated in FIG. 2 in connection with membrane section 34. Thus, intersecting portion 74 of this corner membrane defines first flexible sheet portion 78 and a first dart 80 extending along the inside lateral edge of first flexible sheet portion 78. In the same way, intersecting portion 76 defines second flexible sheet portion 82 and a second dart 84 extending along the inside lateral edge of second flexible sheet portion 82. First dart 80 and second dart 84 are arranged at an angle with respect to one another, which preferably coincides with the angle adaptor sections 56 and 58 define with respect to one another when installed, whereby first and second darts 80 and 84 are easily received in race 36 of these adaptor sections.

Figure 7:
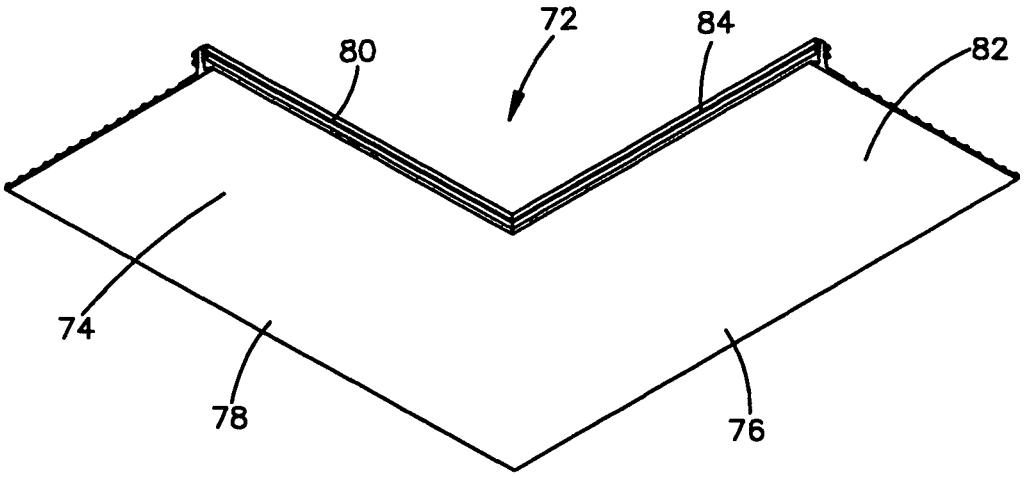
FIG. 7 is a perspective view of the underside of the corner membrane section used in the first embodiment of the inventive barrier assembly, as illustrated in FIGS. 3, 4,5 and 6.

In the particular corner membrane illustrated in FIG. 7, first and second darts 80 and 84 intersect one another. These projections, however, can be spaced from one another at their point of closest approach. If so, the space between these projections should preferably be no greater than about 1 cm.

In the particular embodiment illustrated in FIGS. 3, 4, 5 and 6, sealing membrane 34 is formed from one corner membrane 70 for each corner of the window and one or more membrane sections 72 extending between adjacent pairs of corner membranes. Preferably, sufficient membrane sections and corner membranes are used so that completed sealing membrane 34 extends completely around the entire perimeter of the window frame. See FIG. 6.

In order to form an air and moister-proof seal between adjacent membrane sections and corner membranes, the flexible sheet portions 38 of adjacent sealing membrane sections and corner membranes are preferably overlapped and sealed together with a moisture-proof sealant 74. See, FIG. 5. For this purpose, the overlapping portion of dart 46 "facing" the other overlapping flexible sheet is preferably removed by the installer so that these overlapping sheet portions 38 can lay flat upon one another. The overlapping portion of dart 46 in the other flexible sheet can also be removed, if desired.

As indicated above, a common problem with conventional sealing assemblies made from elastomeric sheets is that, in order to achieve a proper fit at the window's corner, such sheets are typically folded over on themselves, substantially puckered or multiply overlapped with respect to one another, which in turn often leads to an inadequate seal. A particular advantage of the inventive barrier assembly of FIGS. 3, 4, 5, 6 and 7 is that this problem is largely eliminated because pre-fabricated corner sealing membranes are used which are shaped at their inside lateral edges to correspond with the shape of the window frame at its corners.

As indicated above, the individual membrane sections and corner membranes which make up sealing membrane 34 are preferably joined to one another so as to form an air and moisture-proof seal. One way that this can be done, as described above in connection with FIGS. 5 and 6, is to arrange adjacent membrane sections and corner membranes in an overlapping relationship and to seal the flexible sheet portions 34 of the overlapping membrane sections and corner membranes with a moisture-proof adhesive. For this purpose, dart 46 on the "upper" overlapping sheet portion is preferably removed by the installer so that the flexible sheet portions 34 of the "upper" and "lower" overlapping flexible sheet portions can lay flat upon one another. In accordance with another embodiment of the invention, a suitably designed membrane splicing section can be provided for joining adjacent membrane sections without overlap so that the above-projection removal step can be avoided.

Figure 8A:
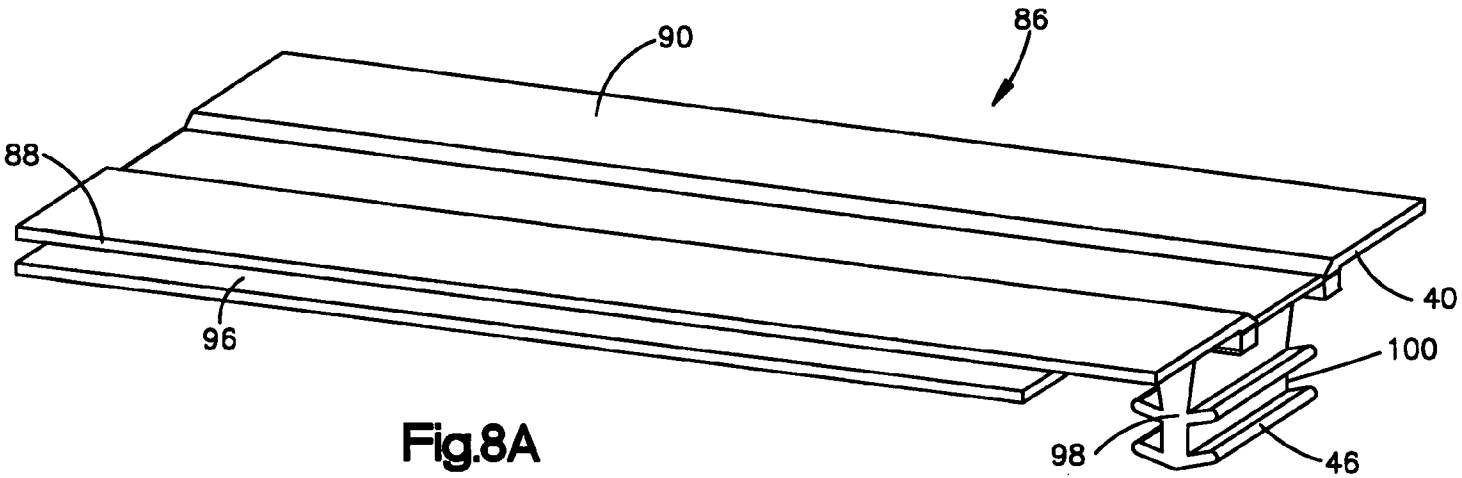
FIGS. 8A and 8B are perspective views illustrating a membrane splicing section that can be used to join adjacent membrane sections according to a second embodiment of the inventive barrier assembly, FIG. 8A being a view from above the membrane splicing section and FIG. 8B being a view from below the membrane splicing section.
Figure 8B:
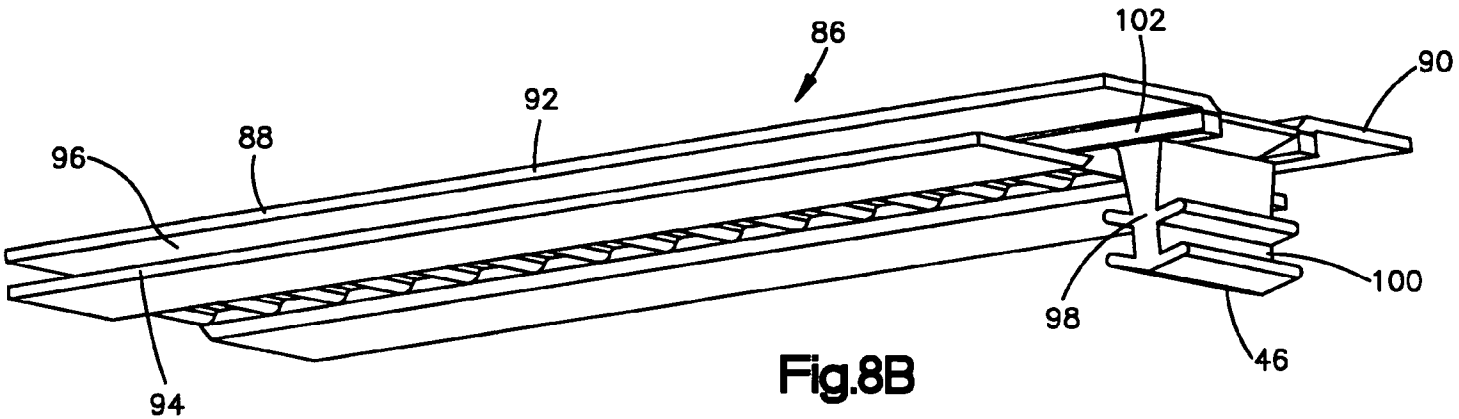

This is illustrated in FIGS. 8A and 8B, which show membrane splicing section 86 which can be used for this purpose. In its central section intermediate its two longitudinal ends, membrane splicing section 86 defines a cross-sectional profile which is generally the same as illustrated in FIG. 2 in connection with membrane section 34. However at each of its longitudinal ends, membrane splicing section 86 defines a coupler 88/90, each of which is designed to receive and hold the mating longitudinal end of an adjacent corner or side membrane section. For this purpose, each of couplers 88 and 90 includes an upper layer 92 and a lower layer 94 forming an extended sheet-receiving slot 96 therebetween. In addition, the longitudinal ends 98 and 100 of projection 46 do not extend the entire length of the inside lateral edge 40 of membrane splicing section 86. Rather, they terminate at (or before reaching) the base 102 of sheet-receiving slot 96.

With this structure, the mating end of an adjacent side or corner membrane section can be inserted into sheet-receiving slot 96 of membrane splicing section 86 without altering this mating end, since interfering portions of membrane splicing section 86 have been omitted. Therefore, adjacent side and corner membrane sections can be securely joined to one another without removing the overlapping portion of projection 46 from one of these adjacent membrane sections as would normally be necessary when overlapping joints are made. A moisture-proof sealant can be inserted into sheet-receiving slot 96 before the mating end of an adjacent membrane section, if desired.

Figure 9:
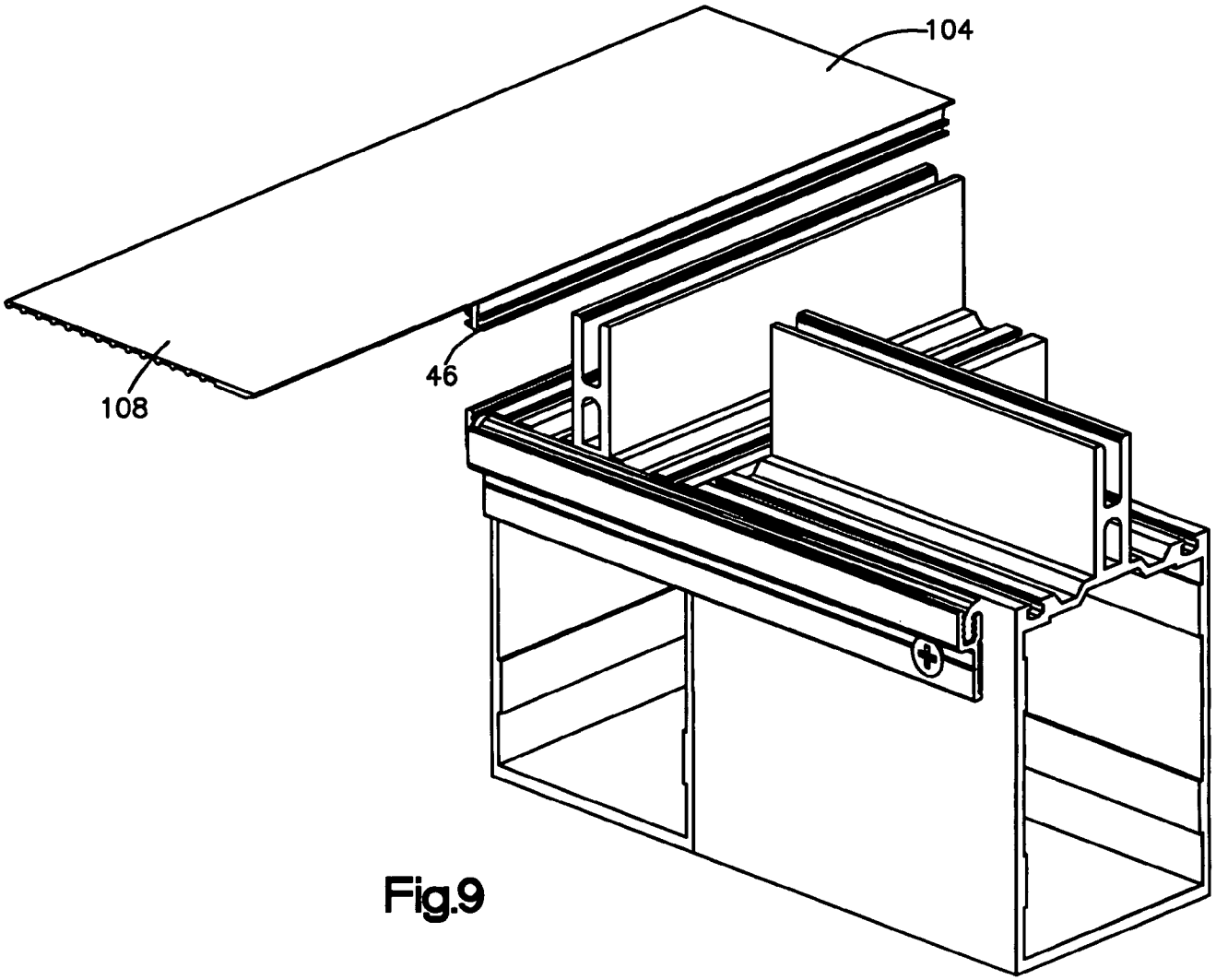
FIGS. 9 and 10 are perspective views illustrating forming the corner portion of a moisture-proof sealing membrane according to a third embodiment of the inventive barrier assembly.
Figure 10:
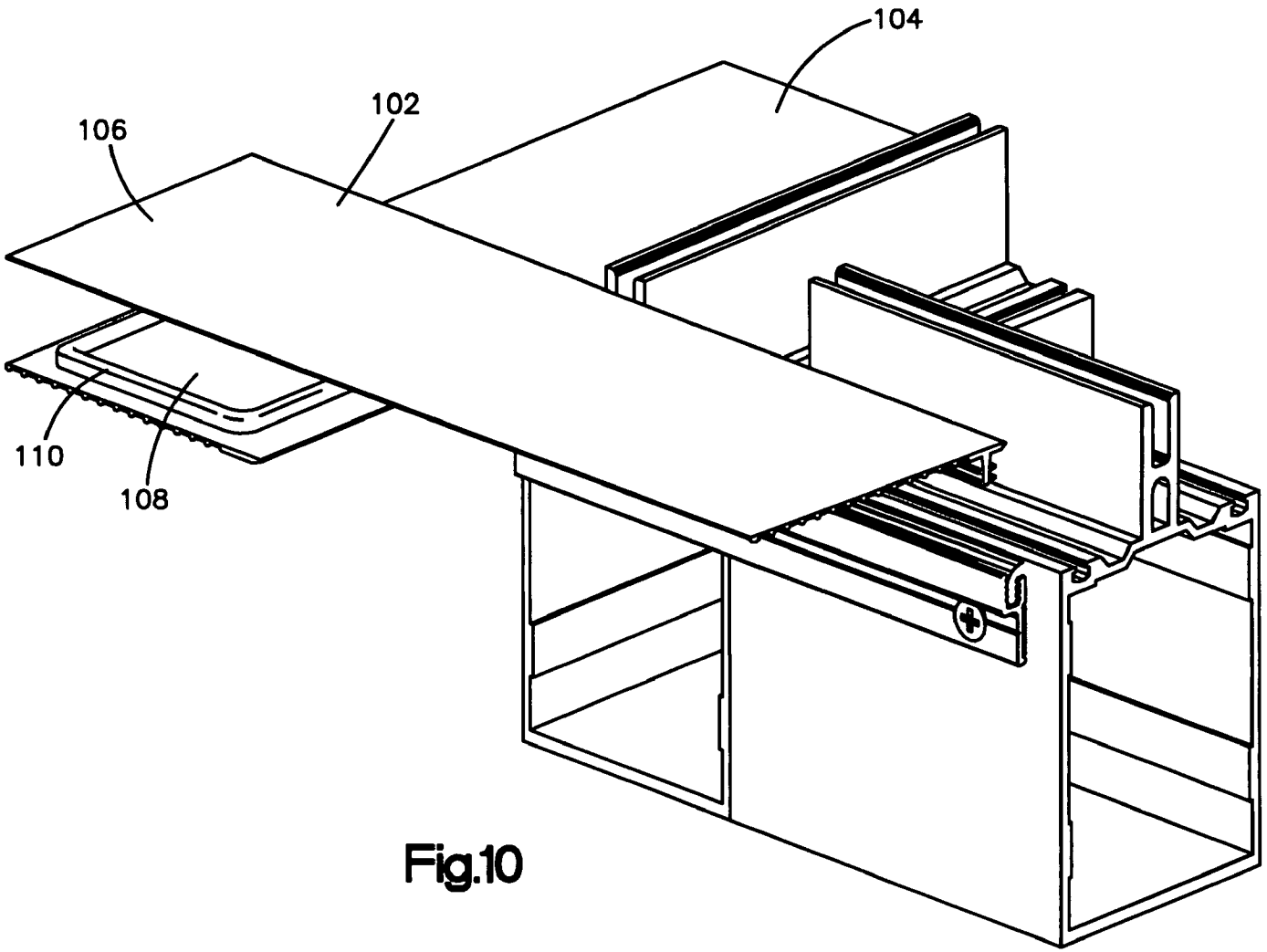

FIGS. 9 and 10 illustrate still another embodiment of the inventive glazing assembly in which corner membranes 72 are not used. Rather in this embodiment, membrane sections 102 and 104 are made long enough so that their mating longitudinal ends 106 and 108 overlap one another as illustrated in these figures. The overlapping portion of dart 46 on "upper" side section 102, i.e. the portion of dart 46 which is carried by the overlapping end of "upper" side section 102, is removed in order that longitudinal ends 106 and 108 can lie flat upon one another, thereby forming a "two-layer" corner section of the sealing membrane. A quantity 110 of a moisture-proof sealant is preferably applied between the overlapped longitudinal ends to effect an air and moisture-proof seal. As shown in FIG. 9, the overlapping portion of dart 46 on "lower" side section 104 can also be removed, if desired, for enhancing the flexibility of the "two-layer" corner portions of the flexible membrane formed in this way.

In still another embodiment (not shown), sealing membrane 34 for a particular window can be preformed at the factory. In other words, the individual membrane sections forming the sealing membrane as a whole can be preassembled and bonded to one another at the factory or elsewhere so that only a single membrane piece, i.e., the pre-formed sealing membrane 34, need be delivered to and installed by the glazer or installer for that window. Such pre-formed sealing membranes will normally be prepared to cover the window gap along the entire 360° of window periphery. However, pre-formed sealing membranes covering less than the entire window periphery can also be used, if desired.

From the foregoing, it can be seen that the inventive barrier assembly can be easily fabricated on-site by a glazer from stock pieces of adaptor 32 and flexible membrane 34 by cutting these stock pieces to length and then attaching the flexible membrane sections so formed to one another. Corner membranes 72 can also be used, if desired. Because the inside perimeter of the flexible sealing membrane formed in this way essentially corresponds to the outside perimeter of the window frame, this flexible sealing membrane can be placed over the gap between the window frame and the building's rough opening in an essentially flat configuration, i.e., without the folding, substantial pucker or multiple overlapping of prior art approaches. This promotes an effective air and moisture-proof seal in a very simple and straight forward manner.

Although only a few embodiments of the inventive barrier assembly have been described above, it should be appreciated that many modifications can be made without departing from the spirit and scope of the invention. For example, although the above disclosure indicates that adaptor 32 and sealing membrane are attached to the window frame so as to seal the outside surface of the building's exterior wall 20, the sealing membrane could be attached so as to seal the inside surface of exterior wall 20, or even the building's fascia at least when made from a moisture-proof material such as masonry, metal or the like. Similarly, although the above disclosure shows the inside lateral edges of corner membrane section forming a right angle with respect to one another, these inside lateral edges can form any angle or shape corresponding to the window frame to be sealed. All such modifications are intended to be included within the scope of the present invention, which is to be limited only by the following claims:

The invention claimed is:

1. A barrier assembly sealing the gap between the frame of a window and the rough opening defined in the exterior structural wall of a building in which the window is received, the rough opening being defined by building framing members, the barrier assembly comprising:

an adaptor attached to the window frame, the adaptor defining a channel along at least a majority of the perimeter of the window frame, and a flexible sealing membrane providing an air and moisture barrier between the window frame and the building framing members, the flexible sealing membrane being formed from multiple membrane sections, at least one of the membrane sections being formed from an elastomeric material, the elastomeric membrane section defining a flexible sheet and a projection integral with the flexible sheet, the projection being received in the channel of the adaptor to provide an air and moisture-proof barrier between the window frame and the associated building framing member, the flexible sheet being wide enough to be sealed to the outside surface of the building's exterior structural wall without overfolding wherein the elastomeric material is butyl rubber, neoprene rubber, EPDM, or silicone rubber.

2. The barrier assembly of claim 1, wherein the flexible sealing membrane is formed from multiple elastomeric membrane sections formed by extruding or molding an elastomeric material into the form of a flexible sheet having a major surface with the projection of the elastomeric membrane section being integral with and projecting from this major surface.

3. The barrier assembly of claim 2, wherein each elastomeric membrane section in its longitudinal direction defines an inside lateral edge associated with the window frame, an outside lateral edge in sealing engagement with an associated building framing member of the building and a major face extending between the inside lateral edge and the outside lateral edge, the projection of each elastomeric membrane section being proximate to, spaced from and extending along a substantial portion of the length of the inside lateral edge.

4. The barrier assembly of claim 3, wherein the projection in transverse cross-section comprises a central shaft projecting from the flexible sheet and multiple protrusions projecting from the shaft, and further wherein the channel of the adaptor defines an assembly of grooves which are sized to cooperate with the protrusions of the projection for enhancing the mechanical connection between the side membrane section and the adaptor.

5. The barrier assembly of claim 2, wherein the channel defined by the adaptor is outwardly facing with respect to the building, wherein the walls of the building are formed from an external wall and a fascia outside the external wall, wherein the walls of the building further include an air barrier between the external wall and the fascia, and further wherein the sealing membrane is sealed to the air barrier by means of an air and moisture-proof seal.

6. The barrier assembly of claim 2, wherein the flexible sealing membrane is formed from multiple elastomeric membrane sections, the flexible sheets of adjacent elastomeric flexible membrane sections being overlapped and sealed to one another thereby forming an air and moisture-proof seal.

7. The barrier assembly of claim 6, wherein overlapping flexible sheets of adjacent elastomeric flexible membrane sections are sealed to one another by a moisture-proof sealant received between these overlapping flexible sheets.

8. The barrier assembly of claim 7, wherein the adaptor section or sections carried by each window frame side section extend substantially the entire length of that window frame side section.

9. The barrier assembly of claim 1, wherein the window frame has corners, each corner being defined by first and second intersecting frame side sections, wherein each intersecting frame side section carries an adaptor section and an associated elastomeric membrane section, wherein the sealing membrane is formed at the corners of the window frame by overlapping these associated elastomeric membrane sections, a portion of the projection of at least one elastomeric membrane section of each pair of overlapping membrane sections being removed so that the overlapping flexible sheets of these overlapping elastomeric membrane sections lie flat upon each other.

10. The barrier assembly of claim 9, wherein the flexible sheets of the overlapping associated elastomeric membrane sections are sealed together with water-proof sealant to form in a two-layer elastomeric membrane section, the two-layer membrane section being sealed to the window frame and associated building framing members of the building without over-folding-or substantial pucker.

11. The barrier assembly of claim 1, wherein the window frame is formed from at least one window frame section having an outer surface facing the associated building framing member of the rough opening in which the window is received, the adapter being attached to the outer surface.

12. The barrier assembly of claim 1, wherein the building is an office building, sky-scraper, factory, school or hospital, and further wherein the window frame sections are made from aluminum or aluminum alloy.

13. The barrier assembly of claim 12, wherein the adaptor is made from metal.

14. The barrier assembly of claim 1, wherein the adaptor is made from metal.

15. The barrier assembly of claim 1, wherein the elastomeric membrane section comprises an elongated essentially planar flexible sheet defining a free inside lateral edge for association with the window frame, a free outside lateral edge for sealing engagement with an associated building framing member, a pair of opposed major faces each extending between the free inside lateral edge and outside lateral edge, and a projection integral with the flexible sheet, the projection projecting directly from one of these major faces at an essentially right angle intermediate the free inside lateral edge and outside lateral edge.

16. The barrier assembly of claim 3, wherein the elastomeric membrane section comprises an elongated essentially planar flexible sheet defining a free inside lateral edge for association with the window frame, a free outside lateral edge for sealing engagement with an associated building framing member, a pair of opposed major faces each extending between the free inside lateral edge and outside lateral edge, and a projection integral with the flexible sheet, the projection projecting directly from one of these major faces at an essentially right angle intermediate the free inside lateral edge and outside lateral edge.

17. The barrier assembly of claim 1, wherein the elastomeric material is silicone rubber.

18. A barrier assembly sealing the gap between the frame of a window and the rough opening of a building in which the window is received, the rough opening being defined by building framing members, the barrier assembly comprising:

an adaptor attached to the window frame, the adaptor defining a channel along at least a majority of the perimeter of the window frame, and a flexible sealing membrane providing an air and moisture barrier between the window frame and the building framing members, the flexible sealing membrane being formed from multiple membrane sections, at least one of the membrane sections being formed from an elastomeric material defining a flexible sheet and a projection integral with the flexible sheet, the projection being received in the channel of the adaptor to provide an air and moisture-proof barrier between the window frame and the associated building framing member, wherein the window frame is defined by window frame side sections and corners, each corner being defined by first and second intersecting frame side sections, wherein each intersecting frame side section carries an adaptor section, wherein the sealing membrane is formed from a separate pre-fabricated elastomeric corner membrane for each corner, wherein each pre-fabricated elastomeric corner membrane comprises a first elastomeric sheet and a first projection integral with and projecting from this first elastomeric sheet as well as a second elastomeric sheet and a second projection integral with and projecting from this second elastomeric sheet, the first and second elastomeric sheets being essentially coplanar and intersecting one another at an essentially right angle, the first and second projections intersecting one another at an essentially right angle, the first projection being received in the adaptor carried by a first window frame side section and a second projection being received in the adaptor carried by a second window frame side section wherein the elastomeric material is butyl rubber, neoprene rubber, EPDM, or silicone rubber.

19. The barrier assembly of claim 18, wherein each pre-fabricated elastomeric corner membrane is formed by molding the elastomeric material to form a flexible sheet having a major surface with each projection being integral with and projecting from this major surface.

20. The barrier assembly of claim 19, wherein each pre-fabricated elastomeric corner membrane is sealed to the window frame and associated building framing members of the building without over-folding or substantial pucker.

21. The barrier assembly of claim 18, wherein each elastomeric membrane section in its longitudinal direction defines an inside lateral edge associated with the window frame, an outside lateral edge in sealing engagement with an associated building framing member of the building and a major face extending between the inside lateral edge and the outside lateral edge, the projection of each elastomeric membrane section projecting from the major face and being proximate to, spaced from and extending along a substantial portion of the length of the inside lateral edge.

22. The barrier assembly of claim 21, wherein the first and second elastomeric sheets of each pre-fabricated elastomeric corner membrane comprise respective first and second essentially planar flexible sheets, each flexible sheet defining a free inside lateral edge for association with the window frame, a free outside lateral edge for sealing engagement with an associated building framing member, a pair of opposed major faces extending between the inside and outside lateral edges of the flexible sheet as well as first and second respective projections, wherein the first projection projecting directly from a major face of the first essentially planar flexible sheet at an essentially right angle, and further wherein the second projection projecting directly from a major face of the second essentially planar flexible sheet at an essentially right angle intermediate the free inside lateral edge and outside lateral edge.

23. The barrier assembly of claim 18, wherein the first and second elastomeric sheets of each pre-fabricated elastomeric corner membrane comprise respective first and second essentially planar flexible sheets, each flexible sheet defining a free inside lateral edge for association with the window frame, a free outside lateral edge for sealing engagement with an associated building framing member, a pair of opposed major faces extending between the inside and outside lateral edges of the flexible sheet as well as first and second respective projections, wherein the first projection projecting directly from a major face of the first essentially planar flexible sheet at an essentially right angle, and further wherein the second projection projecting directly from a major face of the second essentially planar flexible sheet at an essentially right angle intermediate the free inside lateral edge and outside lateral edge.

24. A kit for forming an air and moisture-proof seal between the frame of a window and the rough opening defined in the exterior structural wall of a building in which the window is received, the rough opening being defined by building framing members, the window frame having corners defined by intersecting frame side sections, the kit comprising:

adaptor stock for attaching to a window frame side section, the adaptor stock defining an elongated channel, and sealing membrane stock for forming a sealing membrane for providing an air and moisture barrier between the window frame and the building framing members, the sealing membrane stock being formed from a flexible sheet defining a projection thereon, the projection being sized to closely fit into the elongated channel of the adaptor stock for providing a secure mechanical connection between the sealing membrane stock and the adaptor stock, the flexible sheet being formed from an elastomeric material and being wide enough to be sealed to the outside surface of the building's exterior structural wall without overfolding wherein the elastomeric material is butyl rubber, neoprene rubber, EPDM, or silicone rubber.

25. The kit of claim 24, wherein the adaptor stock comprises an adaptor supply piece for subdividing into multiple adaptor sections and further wherein the sealing membrane stock comprises a sealing membrane stock piece for subdividing into multiple sealing membrane sections.

26. The kit of claim 24, further comprising a supply of moisture-proof sealant for forming an air and moisture-proof seal between overlapping flexible sheets of adjacent sealing membrane sections subdivided from the sealing membrane stock.

27. The kit of claim 24, wherein the sealing membrane stock is formed by extruding or molding the elastomeric material into the form of a flexible sheet having a major surface with the projection of the membrane stock being integral with and projecting from this major surface.

28. The kit of claim 27, wherein the sealing membrane stock in its longitudinal direction defines an inside lateral edge for sealing engagement with the window frame and an outside lateral edge for sealing engagement with an associated building framing member of the building, the projection of the membrane stock being proximate to and extending along a substantial portion of the length of the inside lateral edge.

29. The kit of claim 28, wherein the projection in transverse cross-section comprises a central shaft projecting from the major face of the flexible sheet and multiple protrusions projecting from the shaft, and further wherein the channel of the adaptor defines an assembly of grooves which are sized to cooperate with the protrusions of the projection for enhancing the mechanical connection between the side membrane section and the adaptor.

30. The kit of claim 24, further comprising a container of sealant for applying a water-proof sealant to adjoining membrane sections.

31. The kit of claim 24, wherein the sealing membrane stock in its longitudinal direction defines an inside lateral edge for association with the window frame, an outside lateral edge for sealing engagement with an associated building framing member and a major face extending between the inside lateral edge and the outside lateral edge, the projection projecting from the major face and being proximate to, spaced from and extending along a substantial portion of the length of the inside lateral edge.

32. The barrier assembly of claim 31, wherein the sealing membrane stock comprises an essentially planar flexible sheet defining a free inside lateral edge for association with the window frame, a free outside lateral edge for sealing engagement with an associated building framing member, a pair of opposed major faces each extending between the free inside lateral edge and outside lateral edge, and a projection integral with the flexible sheet, the projection projecting directly from one of these major faces at an essentially right angle intermediate the free inside lateral edge and outside lateral edge.

33. The barrier assembly of claim 24, wherein the elastomeric membrane section comprises an essentially planar flexible sheet defining a free inside lateral edge for association with the window frame, a free outside lateral edge for sealing engagement with an associated building framing member, a pair of opposed major faces each extending between the free inside lateral edge and outside lateral edge, and a projection integral with the flexible sheet, the projection projecting directly from one of these major faces at an essentially right angle intermediate the free inside lateral edge and outside lateral edge.

34. The kit of claim 24, wherein the adaptor is made from metal.

35. A kit for forming an air and moisture-proof seal between the frame of a window and the rough opening in which the window is received, the rough opening being defined by building framing members, the window frame having corners defined by intersecting frame side sections, the kit comprising:

adaptor stock for attaching to a window frame side section, the adaptor stock defining an elongated channel, and sealing membrane stock for forming a sealing membrane for providing an air and moisture barrier between the window frame and the building framing members, the sealing membrane stock being formed from a flexible sheet of elastomeric material defining a projection thereon, the projection being sized to closely fit into the elongated channel of the adaptor stock for providing a secure mechanical connection between the sealing membrane stock and the adaptor stock, wherein the kit further includes at least one pre-fabricated elastomeric corner membrane for forming the corner of the sealing membrane, and wherein the pre-fabricated elastomeric corner membrane comprises a first elastomeric sheet and a first projection integral with and projecting from this first elastomeric sheet as well as a second elastomeric sheet and a second projection integral with and projecting from this second elastomeric sheet, the first and second elastomeric sheets being essentially coplanar and intersecting one another at an essentially right angle, the first and second projections intersecting one another at an essentially right angle, the first projection being received in the adaptor carried by a first window frame side section and a second projection being received in the adaptor carried by a second window frame side section wherein the elastomeric material is butyl rubber, neoprene rubber, EPDM, or silicone rubber.

36. The kit of claim 35, wherein each pre-fabricated elastomeric corner membrane defines first and second intersecting corner membrane sections, each corner membrane section defining an inside lateral edge associated with the window frame, an outside lateral edge associated with a building framing member, a major face extending between the inside and outside lateral edges, and a projection projecting from the first major face, the projection being spaced from both inside and outside lateral edges and extending along substantially the entire length of the inside lateral edge.

37. The kit of claim 36, wherein each pre-fabricated elastomeric corner membrane is formed by molding the elastomeric material to form a flexible sheet having a major surface with each projection being integral with and projecting from this major surface.

38. The barrier assembly of claim 35, wherein the first and second elastomeric sheets of each pre-fabricated elastomeric corner membrane comprise respective first and second essentially planar flexible sheets, each flexible sheet defining a free inside lateral edge for association with the window frame, a free outside lateral edge for sealing engagement with an associated building framing member, a pair of opposed major faces extending between the inside and outside lateral edges of the flexible sheet as well as first and second respective projections, wherein the first projection projecting directly from a major face of the first essentially planar flexible sheet at an essentially right angle, and further wherein the second projection projects from a major face of the second essentially planar flexible sheet at an essentially right angle intermediate the free inside lateral edge and outside lateral edge.

39. An elastomeric corner membrane for combining with elongated adaptors thereby forming an air and moisture-proof seal between the frame of a window and the associated building framing members of a building defining the rough opening in which the window is received, the window frame having corners defined by intersecting frame side sections, the corner membrane comprising:

a first elastomeric sheet and a first projection integral with and projecting from this first elastomeric sheet as well as a second elastomeric sheet and a second projection integral with and projecting from this second elastomeric sheet, the first and second elastomeric sheets being essentially coplanar and intersecting one another at an essentially right angle, the first and second projections intersecting one another at an essentially right angle, the first and second elastomeric sheets each defining an inside lateral edge for association with the window frame and an outside lateral edge for association with a building framing member, the first projection being spaced from both inside and outside lateral edges of the first elastomeric sheet and extending along the inside lateral edge of the first elastomeric sheet, the second projection being spaced from both inside and outside lateral edges of the second elastomeric sheet and extending along the inside lateral edge of the second elastomeric sheet, each projection being sized to closely fit into the channel of an associated adaptor for providing a secure mechanical connection between the membrane section and the adaptors, the corner membrane being formed from a molded elastomeric material whereby the projection and flexible sheet of the membrane are integral with respect to one another wherein the elastomeric material is butyl rubber, neoprene rubber, EPDM, or silicone rubber.

40. The elastomeric corner membrane of claim 39, wherein the elastomeric corner membrane is made from silicone rubber.

41. The barrier assembly of claim 39, wherein the first and second elastomeric sheets of the elastomeric corner membrane comprise respective first and second essentially planar flexible sheets, each flexible sheet defining a free inside lateral edge for association with the window frame, a free outside lateral edge for sealing engagement with an associated building framing member, a pair of opposed major faces extending between the inside and outside lateral edges of the flexible sheet as well as first and second respective projections, wherein the first projection projecting directly from a major face of the first essentially planar flexible sheet at an essentially right angle, and further wherein the second projection projecting directly from a major face of the second essentially planar flexible sheet at an essentially right angle intermediate the free inside lateral edge and outside lateral edge.

42. A sealed window frame section sealing the gap between the frame section and an adjacent building framing member, the adjacent building frame member defining a portion of the exterior structural wall of the building in which the window frame section is received, the sealed window frame section comprising:

a window frame section defining a channel along at least a majority of its perimeter, and a flexible sealing membrane section providing an air and moisture barrier between the window frame section and the adjacent building framing member, the flexible sealing membrane section being formed from an elastomeric material, the flexible sealing membrane defining a flexible sheet and a projection integral with the flexible sheet, the projection being received in the channel of the adaptor to provide an air and moisture-proof barrier between the window frame and the associated building framing member, the flexible sheet being sealed to the outside surface of the building's exterior structural wall without overfolding wherein the elastomeric material is butyl rubber, neoprene rubber, EPDM, or silicone rubber.

43. The sealed window frame section of claim 42, wherein the window frame section has an outer surface facing the adjacent building framing member, the adapter being attached to the outer surface.

44. The barrier assembly of claim 42, wherein the flexible sealing membrane section comprises an essentially planar flexible sheet defining a free inside lateral edge for association with the window frame, a free outside lateral edge for sealing engagement with an associated building framing member, a pair of opposed major faces each extending between the free inside lateral edge and outside lateral edge, and a projection integral with the flexible sheet, the projection projecting directly from one of these major faces at an essentially right angle intermediate the free inside lateral edge and outside lateral edge.

45. The barrier assembly of claim 42, wherein the elastomeric material is silicone rubber.

* * * * *